US008083660B2

(12) United States Patent
Chaturvedi

(10) Patent No.: US 8,083,660 B2
(45) Date of Patent: Dec. 27, 2011

(54) RE-CLOSABLE FLEXIBLE PACKAGE AND METHOD OF MANUFACTURING THE SAME

(76) Inventor: Ashok Chaturvedi, Maharashtra (IN)

( * ) Notice: Subject to any disclaimer, the term of this patent is extended or adjusted under 35 U.S.C. 154(b) by 1006 days.

(21) Appl. No.: 11/597,359

(22) PCT Filed: Jul. 5, 2004

(86) PCT No.: PCT/IN2004/000199

§ 371 (c)(1),
(2), (4) Date: May 22, 2007

(87) PCT Pub. No.: WO2005/113357

PCT Pub. Date: Dec. 1, 2005

(65) Prior Publication Data

US 2007/0274612 A1 Nov. 29, 2007

(30) Foreign Application Priority Data

May 21, 2004 (IN) ..... 582/MUM/2004

(51) Int. Cl.
*B65D 33/10* (2006.01)

(52) U.S. Cl. ..... 493/213; 493/226

(58) Field of Classification Search ..... 493/212, 493/213, 226

See application file for complete search history.

(56) References Cited

U.S. PATENT DOCUMENTS

| | | | | |
|---|---|---|---|---|
| 4,840,611 | A * | 6/1989 | Van Erden et al. | 493/213 |
| 6,257,763 | B1 | 7/2001 | Stolmeier et al. | |
| 6,425,847 | B1 | 7/2002 | Broenstrup et al. | |
| 6,464,394 | B1 * | 10/2002 | Galomb | 383/10 |
| 6,796,932 | B2 * | 9/2004 | Kuge et al. | 493/218 |
| 7,331,917 | B2 * | 2/2008 | Totani | 493/244 |
| 7,775,957 | B2 * | 8/2010 | Totani | 493/210 |
| 2001/0051008 | A1 * | 12/2001 | Wedi et al. | 383/63 |
| 2002/0103067 | A1 | 8/2002 | Bois | |
| 2002/0147090 | A1 * | 10/2002 | Kuge et al. | 493/162 |
| 2003/0185467 | A1 | 10/2003 | Buchanan et al. | |
| 2003/0188514 | A1 | 10/2003 | Bois Henri | |
| 2004/0109616 | A1 * | 6/2004 | Winiecki | 383/64 |
| 2004/0109617 | A1 * | 6/2004 | Winiecki | 383/64 |
| 2004/0258332 | A1 * | 12/2004 | Totani | 383/120 |
| 2007/0201770 | A1 * | 8/2007 | Baner et al. | 383/6 |
| 2009/0175565 | A1 * | 7/2009 | Totani | 383/120 |

FOREIGN PATENT DOCUMENTS

| | | | |
|---|---|---|---|
| DE | 297 02 222 | U1 | 4/1997 |
| GB | 859 160 | A | 1/1961 |

* cited by examiner

*Primary Examiner* — Hemant M Desai

(74) *Attorney, Agent, or Firm* — Birch, Stewart, Kolasch & Birch, LLP

(57) ABSTRACT

The invention provides for a re-closable flexible package with gussets (2, 3, 4) on the sides and bottom for increasing its volume and providing ease of storage comprising: —a slider zipper assembly (5, 6) to open and close said package; —a diaphragm (7) of at least one metalized film placed below the slider zipper assembly to seal the package and act as barrier making it tamper proof; —a scoring line (45) on said diaphragm (7) for making it easier and more convenient for the user to tear open and access the contents of the package; —a handle (8) made of a laminate for ease in lifting or carrying the flexible package.

3 Claims, 8 Drawing Sheets

DETAIL 'A'
( SHOWING DETAIL OF LASER CUT)

RE-CLOSABLE FLEXIBLE PACKAGE AND METHOD OF MANUFACTURING THE SAME

This application claims the benefit under 35 U.S.C. Section 371, of PCT International Application No. PCT/IN04/00199, filed Jul. 5, 2004, which claimed priority to Indian Application No. 582/MUM/2004, filed May 21, 2004, in the Indian Patent Office, the disclosures of which are hereby incorporated by reference.

FIELD OF THE INVENTION

The present invention relates to a re-closable flexible package with a slider zipper assembly and three-side gusset having a handle and a method of manufacturing the same.

BACKGROUND OF INVENTION

Heretofore, the primary market for slider bags has been consumers who purchase a package of empty slider bags and then fill the slider bags with products at home. However, with the increasing popularity of the slider bags, product manufacturers have become interested in packaging their food and non-food products in slider bags for sale to consumers. The slider bags are a great convenience to the consumer who purchases these product filled bags especially for products of the type where only a portion of the product is used at any given time. The product applications for which slider bags may be used are virtually unlimited.

Existing flexible packages with zipper assemblies suffer from problems such as not being able to retain aroma and freshness of food and other articles packaged inside them during transportation and storage. Hence, by the time the contents of the package reach the end user they are insipid. Furthermore, said zipper slider assemblies do not provide any adequate tamper-proof feature for informing the end user whether the package has been opened previously or not.

U.S. Pat. Nos. 5,435,864 and 5,425,825 disclose plastic bags having a re-closable plastic zipper and non re-closable peel seal. In U.S. Pat. No. 5,435,864, the peel seal is formed by co-extruding an adhesive onto a side strip adjacent to the interlocking zipper while, in U.S. Pat. No. 5,425,825 applying adhesive to the side strip forms the seal. Further, the barrier provided by a peel seal is permeable and is not strong enough for preventing undesired aroma, microorganisms, and moisture from entering into packages containing food items, thereby making the packaged items vulnerable to fast deterioration.

US Patent Application No. 2002/0021499A1 discloses a flexible re-closable package having a re-closable zipper construction openable and closable by a slider device, and a primary tamper evident structure disposed over the zipper for indicating whether access has been gained to the interior of the package. The package also has a second tamper evident structure consisting of a polymeric film or a peel seal, which is permeable. As a result, the structure has very limited barrier properties to prevent undesired aroma, microorganisms, and moisture from the atmosphere from entering the package. At the same time, the structure is not capable of retaining inside the package the desired aroma, microbe free air and gases like nitrogen that are filled in the package containing food items for keeping them fresh.

The further disadvantage of the above U.S. Pat. Nos. 5,435,864 & 5,425,825 and US Patent Application no. 2002/0021499A1 using a polymeric film extruded together with the zipper profile for providing tamper evident structure is that it limits the choice of material in case a structure having special properties such as capable of being holographed or printed is required for the package.

Further, flexible packaging with only two side gussets result in curved surfaces on the front and backside and therefore create a difficulty in stacking and also waste storage space.

In our co-pending application number 1260/mum/2003, we have described a slider zipper assembly with a diaphragm for a three-side gusset pouch that overcomes the aforementioned drawbacks. The application describes a flexible package with gussets on three sides and a slider zipper assembly that has a diaphragm of a metalized film that makes the package tamper proof and acts as a barrier against external environmental forces.

Although the diaphragm described in the said co-pending patent application has strong barrier properties and also provides a tamper evident feature, it is difficult for the end user to tear open the diaphragm to access the contents of the flexible package.

One of the conventional approaches used to overcome the aforementioned drawback involves perforating the diaphragm for making it easier to tear open. However, such a perforation compromises the barrier property of the diaphragm and hence, of the flexible package. Therefore, it is not fit in cases where the barrier is an essential requirement for storing the contents in the flexible package.

In our co-pending application number 718/mum/2003, we have described an improved slider zipper assembly with a diaphragm for flexible packages that overcomes the above-mentioned drawbacks and provides a zipper slider assembly with diaphragm having a score line for flexible packages that is more convenient for the user to tear open to access the contents of the package and at the same time possesses strong barrier properties for maintaining the desired aroma and freshness of food and other articles packaged inside the flexible package during transportation and storage till such time that they reach the end user. The means for scribing the score line include lasers and water jet technology.

Though the bags as described above offer excellent storage and storing properties, the end user or customer experiences some inconvenience in carrying such a bag that is filled. More particularly a completely filled flexible package as described above would require the end user to use both his hands to lift.

Conventional flexible packages usually come with moulded handles or handles punched in the package itself. An example of such a flexible package is the commonly available plastic/polyethene bags. The other types of bags with handles are usually jute or cloth bags. Flexible packages or bags with punched holes for handles as shown in EP 0524487 A1 and U.S. Pat. Nos. 6,533,711 and 6,053,635 waste the net storage space of the bag. In addition such flexible packages also permit wastage of material around the punched in handle.

U.S. Pat. No. 6,481,183 describes a bag made of a resilient material such as plastic that is made on a form, fill and seal machine. That is the bag is formed, filled with the specified contents and sealed at the same place. The bag as described cannot be used to fill contents at end users place. A lot of countries, including India, get the bags or flexible packages made elsewhere and do the filling and sealing at their own premises, to save on investment and production costs. The document further describes a stand up bag that has a vertical slider zipper along the centre or side of the bag and not covering the entire length. Accordingly the entire area of the bag cannot be used to fill. Further, the bag is unsuitable for solids, and in particular solids having width equal to or greater than the length of zipper. The bag as described also suffers from the following disadvantages in that it does not provide convenience in refilling after first use, in particular contents such as biscuits or sandwiches. The handle on the bag as shown in the document wastes storage space as well as material around the handle.

It is therefore an object of the invention to provide a flexible packaging with a slider zipper assembly, a diaphragm to provide the seal and tamper proof properties; a three side gusset to maximize package capacity and to aid in storage and that has a handle that provides convenience to the end user.

OBJECTS AND SUMMARY OF THE INVENTION

To overcome the aforementioned drawbacks the invention provides for a flexible packaging with a slider zipper assembly and three-side gusset having a handle.

It is an object of the invention to provide an improved flexible package that has a handle thereby providing for ease in handling and carrying.

It is an object of the invention to provide an improved flexible package that has a handle while maintaining the aesthetic appeal of the package.

It is an object of the invention to provide an improved flexible package that has a handle that can be printed upon.

It is an object of the invention to provide an improved flexible package that has a handle that does not use unnecessary material thereby aiding saving of material.

To meet the aforementioned objectives the invention provides for a re-closable flexible package with gussets (2, 3, 4) on the sides and bottom for increasing its volume and providing ease of storage comprising:

- a slider zipper assembly (5, 6) to open and close said package;
- a diaphragm (7) of at least one metalized film placed below the slider zipper assembly to seal the package and act as barrier making it tamper proof;
- a scoring line (45) on said diaphragm (7) for making it easier and more convenient for the user to tear open and access the contents of the package;
- a handle (8) made of a laminate for ease in lifting or carrying the flexible package.

The invention also provides for a method of manufacturing a re-closable flexible package with a handle comprising the steps of:

- inserting a side gusset tube between the parallel sheets of laminate, folding edges of the tube and pre-sealing the same;
- inserting a bottom gusset between the said sheets of laminate, folding and pre-sealing the same;
- inserting pre-cut handles between said sheets of laminate opposite to the bottom gusset;
- inserting a pre-sealed zipper and diaphragm between the handles;
- sealing the edges of the package to form the side and bottom gussets and sealing the slider zipper and handle;
- slitting the bag along the side gusset tube to form the re-closable package with side and bottom gussets with slider zipper and handle.

BRIEF DESCRIPTION OF ACCOMPANYING DRAWINGS

The accompanying drawings illustrate the preferred embodiments of the invention and together with the following detailed description serve to explain the principles of the invention.

DETAILED DESCRIPTION OF THE INVENTION

It will be understood by those skilled in the art that the foregoing general description and the following detailed description are exemplary and explanatory of the invention and are not intended to be restrictive thereof.

Through out the patent specification, a convention employed is that in the appended drawings, like numerals denote like components.

Figure 1:
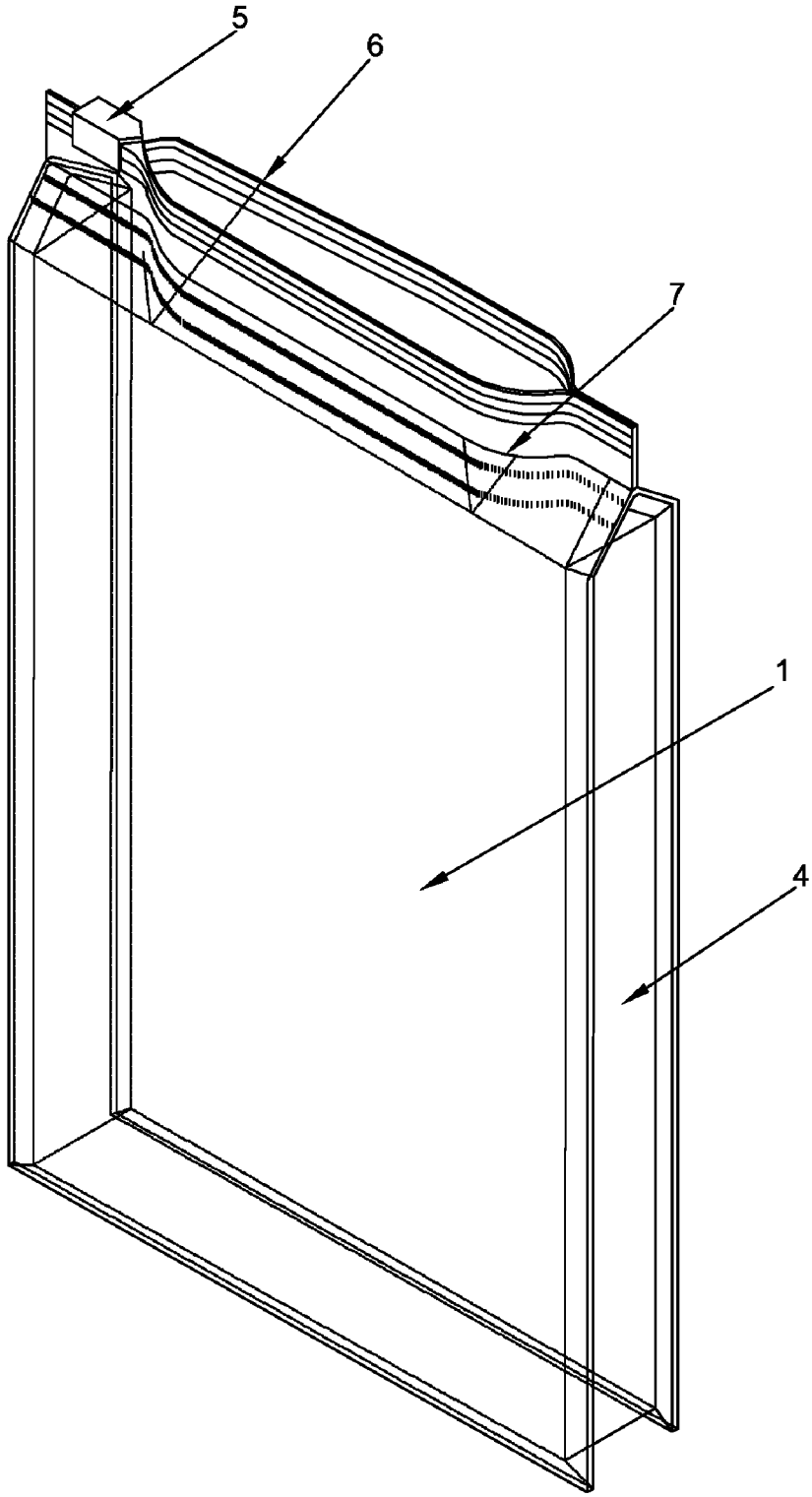
FIG. 1 shows a slider zipper assembly with a diaphragm and three-side gusset as described in our co-pending application 1260/mum/2003.
Figure 2:
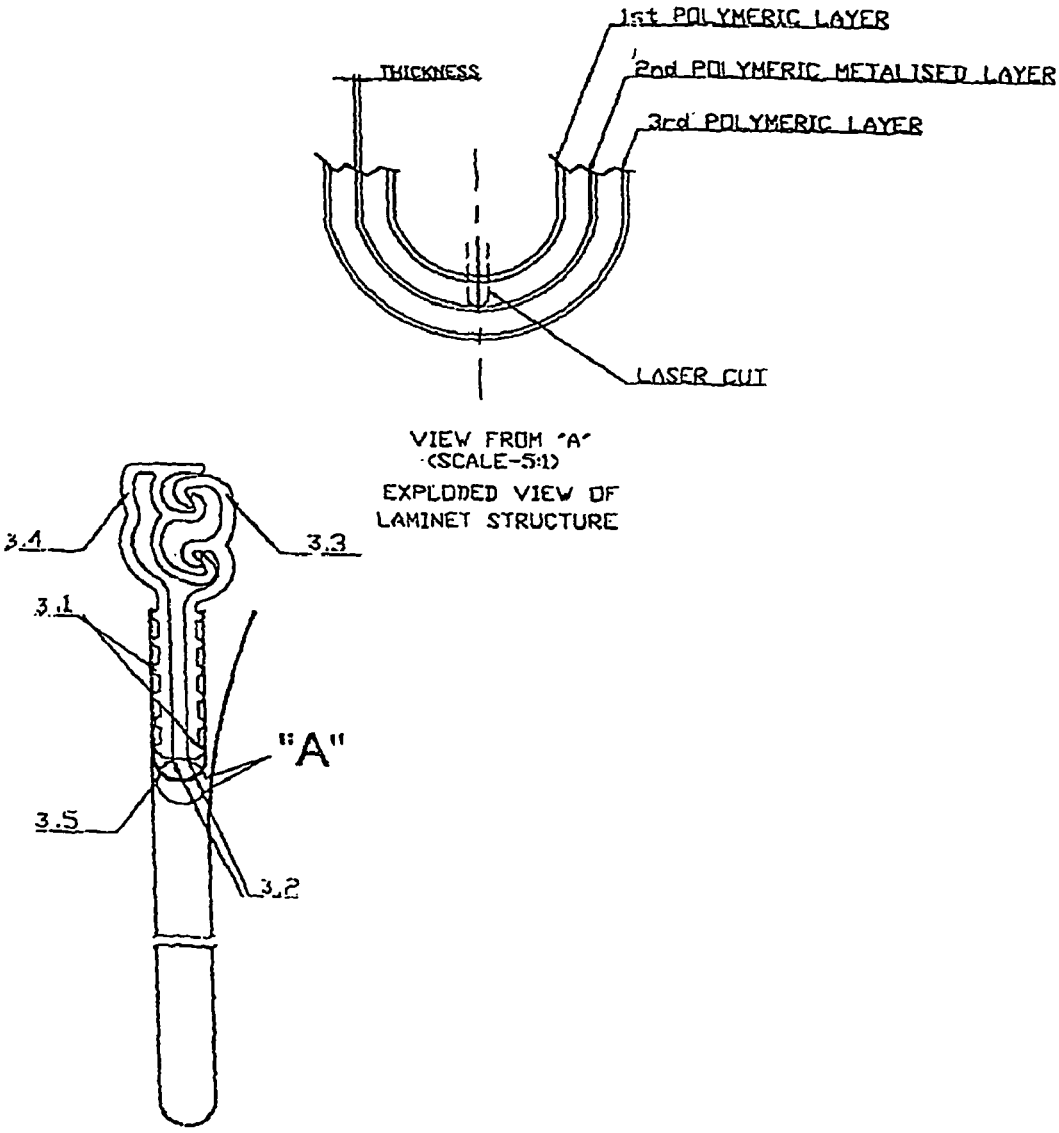
FIG. 2 shows the scoring line on diaphragm of a flexible package as described in our co-pending application 718/mum/2003.
Figure 3:
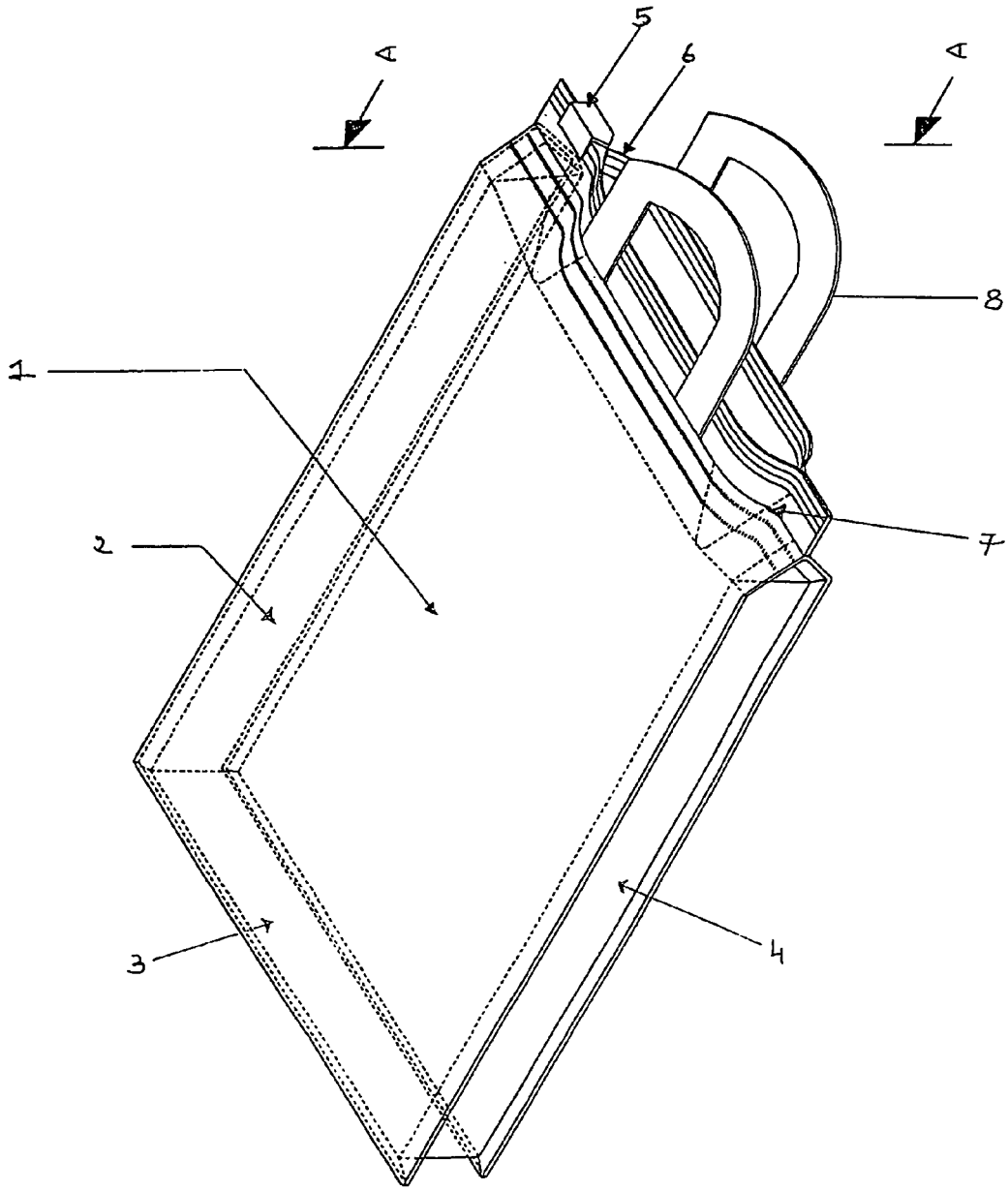
FIG. 3 shows the improved flexible package with a slider zipper assembly and three-side gusset having a handle in accordance with the invention.

With reference to FIG. 3 a flexible package with a slider zipper assembly and three-side gusset having a handle in accordance with the invention is shown. The improved flexible package is in the shape of a bag or pouch and consists of two substantially parallel sheets of polymer (1) that are joined at three edges by the use of gussets (2, 3 and 4). The use of the gussets or additional strips of material on three sides increases the volume of the bag. Further, the bottom gusset (3) also allows the bag to be stored on shelves easily, due to its stand up characteristic.

The surfaces (1) of the pouch in accordance with the invention consists of the following 4 layers:

1. Outer binding polymeric layer.
2. A printed polymeric layer.
3. A metalized polymeric layer.
4. Inner binding polymeric layer.

FIG. (8) shows an exploded view of the above 4 layers. However, the printed layer is an optional layer and need not be present in the gusset.

Also, the use of the layers depends on the contents of the sachet pouch. The layers vary depending on whether the contents of the sachet pouch are edible or non-edible. For example, in the case of edible products such as tomato ketchup, sugar and mouth freshener, all 4 layers as listed above have to be used. More particularly, the metalized polymeric layer becomes critical as a barrier against the external environment. In the case of non-edible contents such as shampoo, shaving gel and face cream, the metalized polymeric layer may be absent.

Materials used for the polymeric layers may be Low Density polyethylene (LDPE), Cast Polypropylene (CPP), Blown Oriented Polypropylene (BOPP) etc. Material used for the printed polymeric layer (9) may be nylon, polyactyal or polyester. Similarly, the metalized polymeric layer may be made of material such as polyester or metpet.

The bag is provided on the fourth side with a slider zipper assembly to allow the bag to be sealed and resealed. The slider zipper assembly consists of a slider (5) slideably mounted on the zipper (6). Any known kind of slider zipper assembly may be used. Preferably the slider zipper assembly as described in co-pending application 1128/mum/2002 may be used.

The bag is provided with a tamper proof feature below the slider zipper assembly. A diaphragm (7) of a polymeric material is used to seal the pouch. The diaphragm is also preferable made of the four layers as listed above. It will make the package tamper proof and also will act as a barrier not allowing any gas, oxygen moisture and the like to enter through it protecting the packed articles from deterioration. In other words, it will maintain the aroma and freshness of the food article even during transportation.

With reference to FIG. 3 again the bag is provided with a handle (8) as shown. The handle may be made of any polymer material or laminate, and is preferably made of the same material as the bag. The handle utilizes minimum material and is strong enough to withstand the weight of the bag with contents. The thickness of the laminate varies as per the requirement. Heretofore, though handles made of laminate were available they did not come on a bag with a slider zipper assembly and with gussets on three sides as well as a tamper proof diaphragm with a scoring line for easy tear.

The handle provides for easy carrying and handling of the bag, does not utilize much material and does not waste storage space.

Figure 4:
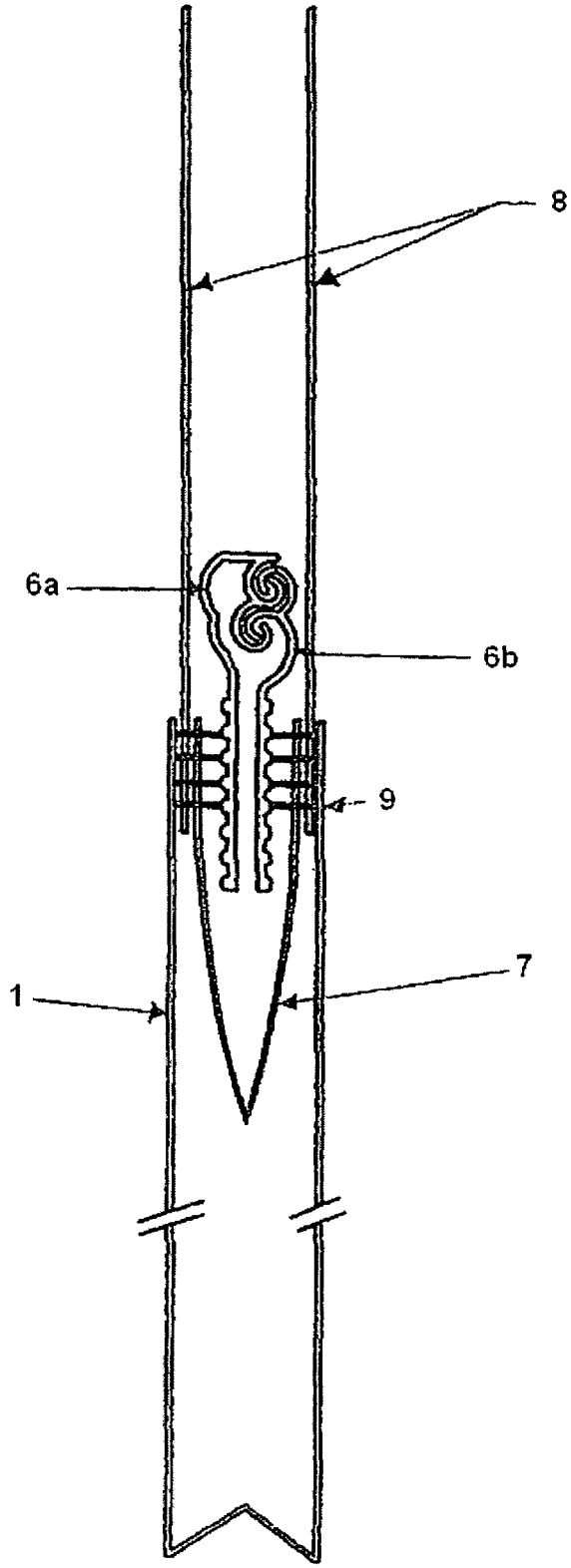
FIG. 4 shows a cross sectional view of the improved flexible package of FIG. 3.

FIG. 4 shows a cross sectional view taken along A-A of FIG. 3. As shown, the handle (8) is affixed to the bag between the side surfaces (1) and the tamper proof diaphragm (7). The zipper (6) consisting of the male and female elements (6*a* and 6*b*) is shown secured between the tamper proof diaphragm (7).

Figure 5:
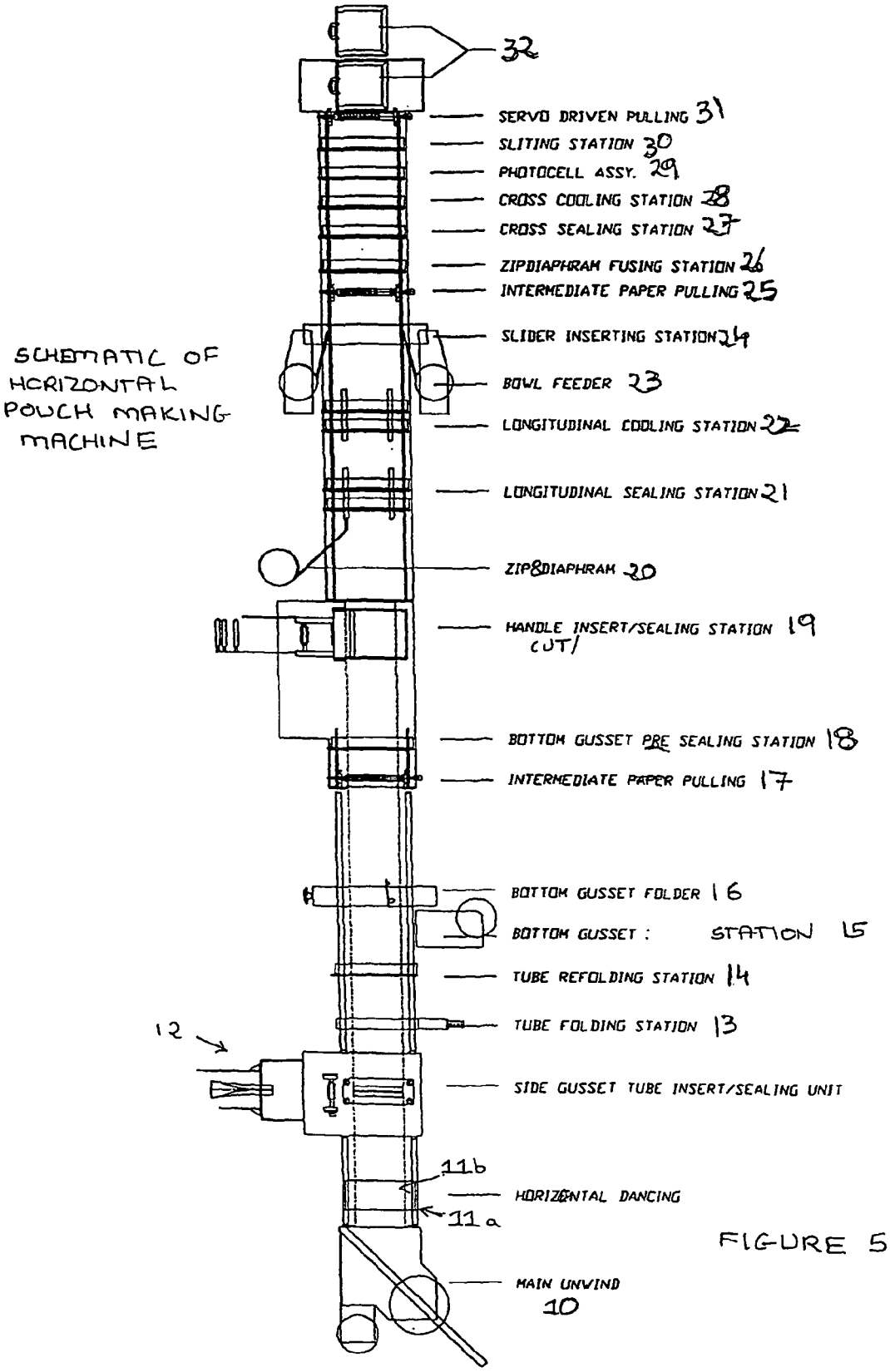
FIG. 5 depicts the method and machine for making the improved flexible package in accordance with this invention.

The three-side gusset pouch with slider zipper assembly, diaphragm with a scoring line, and handle, in accordance with this invention is manufactured on horizontal pouch making machine as illustrated in FIG. 5. The process starts from unwinding polymeric laminate film from a roll, folding and sealing it to the shape of pouch inserting side gussets and bottom gusset, fixing zipper diaphragm from one side and top handle to the pouch. The following description explains in detail the steps involved in the manufacture of the bag.

As shown in FIG. 5, a film roll in proportion to the width of pouch is taken on main unwinding unit (10), is slit in two parts and folded on itself by conventional unwinding method. After cutting the laminate from the centre across the width of the roll, one half of the laminate is sent to the upper dancing roller (11*a*) while the other half is sent to the lower dancing roller (11*b*). The dancing rollers are provided to maintain tension in film as it is pulled through the slitter of the main unwind unit (10). The laminate is now in horizontal position with two parallel sheets one above the other.

The parallel sheets of the laminate are then pulled towards the side gusset inserting and sealing unit (12). At this station, a side gusset in the form of a tube is inserted at predetermined distances along the length of the laminate as shown in FIG. (6). The laminate sheets along with the side gusset then proceed towards the tube folding station (13) wherein side gusset is given the semicircular shape and then to a tube refolding station (14) wherein the final shape to the side gusset is given.

Figure 6:
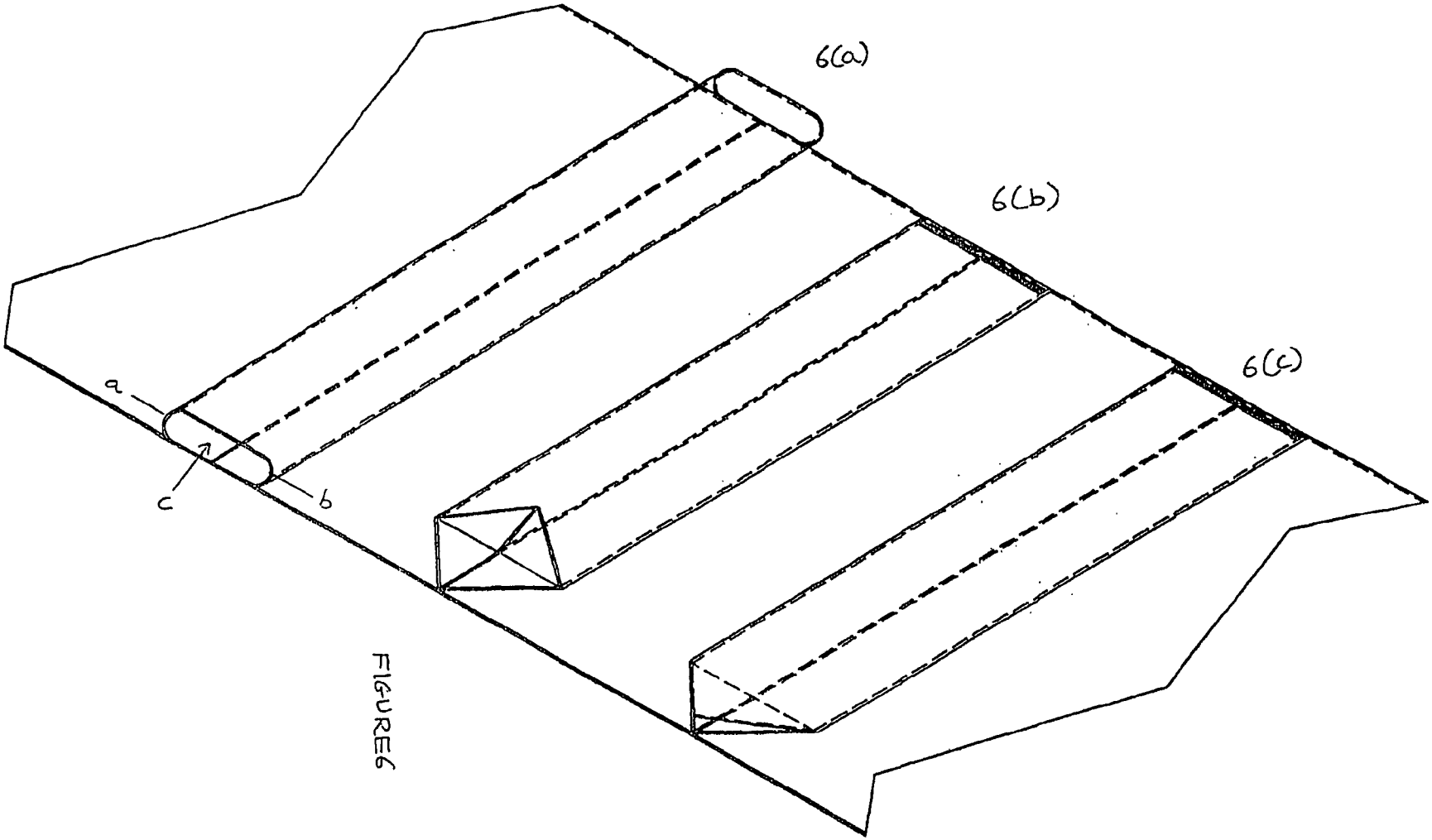
FIG. 6 illustrates the insertion of the side gussets in the shape of tubes at predetermined distances between the parallel sheets of laminate in accordance with this invention.
Figure 7:
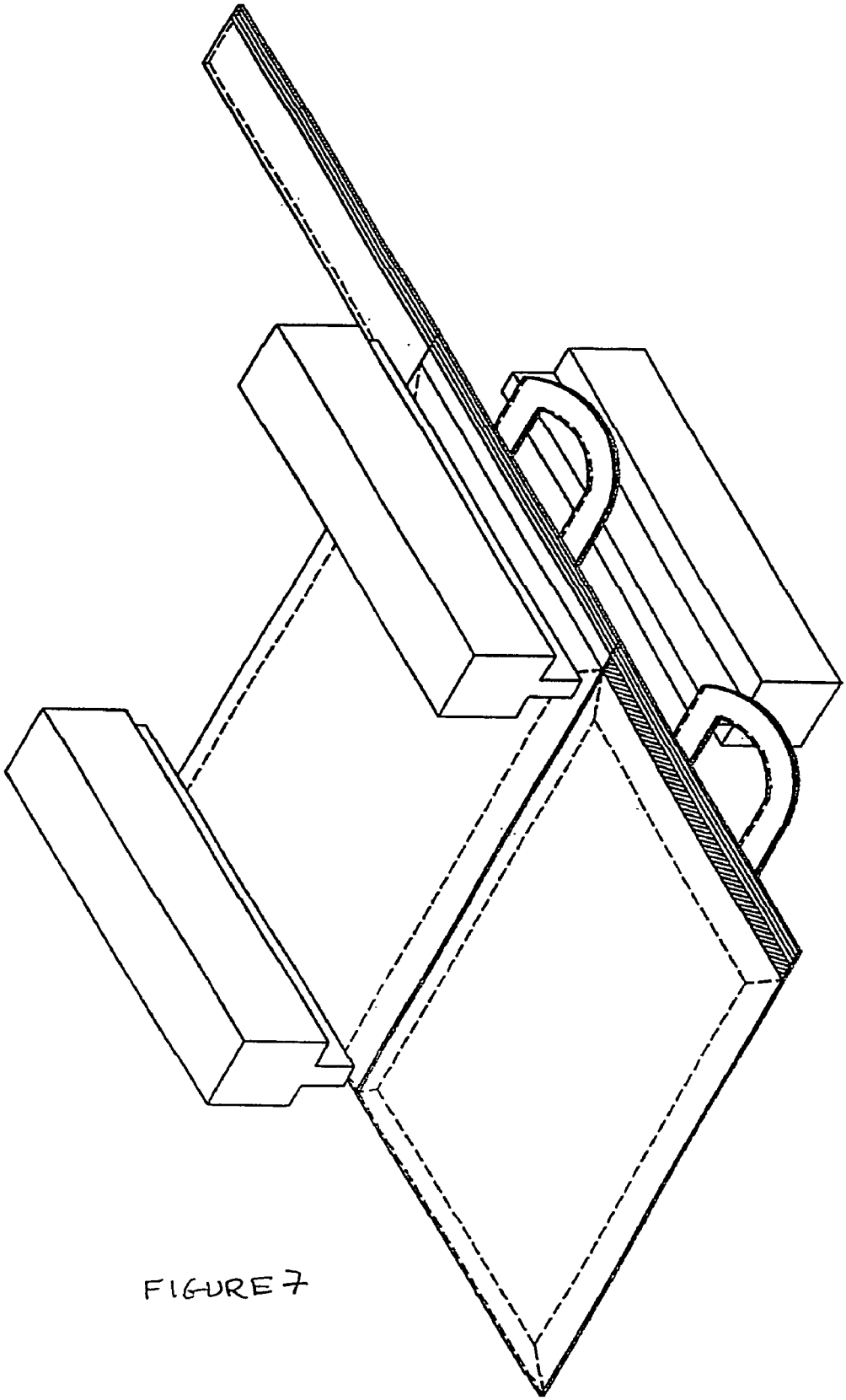
FIG. 7 illustrates the sealing of the bottom gusset and the zipper along with diaphragm is sealed to the parallel sheets of laminate.
Figure 8:
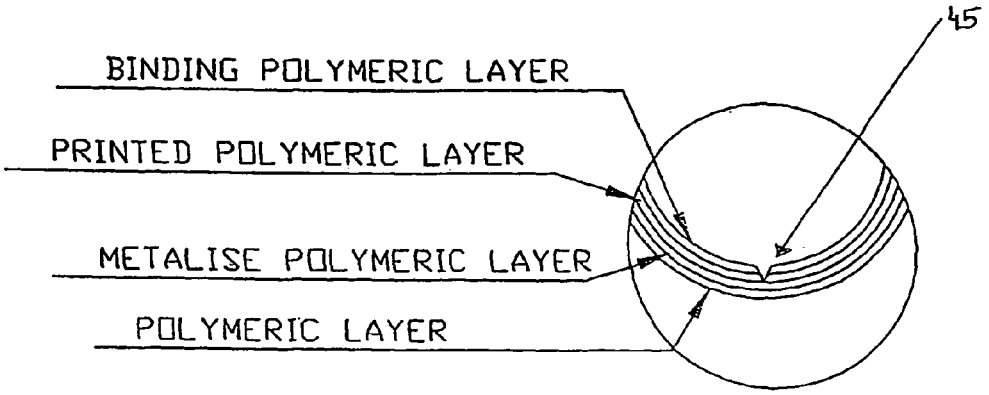
FIG. 8 illustrates the exploded view of the four layers used for the manufacture of bag in accordance with this invention.

These steps can be better understood with reference to FIG. (6). FIG. 6(*a*) illustrates the insertion of the side gusset in the shape of a tube that is given the semi-circular shape with edges "a" and "b". For sake of simplicity the upper laminate is not shown. A pre-scaling action is carried out at station (12). At tube folding station (13), the opening "c" is closed by bringing edges "a" and "b" together. The edges are folded inwards in a manner such that a triangular shape is given to the edges of the gusset tube, as shown in FIG. 6(*b*). The side gusset tube is then given its final shape at tube refolding station (14) as shown in FIG. 6(*c*). The parallel sheets of laminate are finally slit to give the bag with side gussets at slitting station (30).

Referring again to FIG. 5 the sheets of laminate along with the side gusset in shape are then pulled towards a bottom gusset station (15). Station (15) comprises of a roll of the gusset film that is unwound and inserted in between the parallel sheet of laminate, by means of the gusset folder (16). To maintain the tension in the sheets of film, intermediate pulling stations are provided (17, 25). The bottom gusset pre-sealing station (18) then performs a primary sealing action to seal the bottom gusset in between the sheets of laminate.

In accordance with this invention, a handle is cut from a roll of film in the shape of handle and inserted between the parallel sheets of laminate and sealed to the laminates at station (19).

A zipper and a diaphragm for sealing contents of the bag are then inserted between the parallel sheets of laminate at station (20) as shown in FIG. (6). The diaphragm is already provided with a scoring line that allows for easy tear and access to the contents of the bag. The sheets of laminate along with the handle, gussets, zipper and diaphragm are then pulled towards a longitudinal sealing station (21) where the bottom gusset and the zipper along with diaphragm are sealed to the parallel sheets of laminate. This step is illustrated in detail in FIG. (8). In order to give strength and finish to the seal the longitudinal sealing action is followed by longitudinal cooling action at station (22). The sliders are inserted on to the zipper at slider inserting station (24). These are segregated and aligned for placement by bowl feeder (23). The insertion of the slider is then followed by another sealing action wherein the zipper and diaphragm are sealed together and also to the laminate. This sealing action is followed by another sealing action at station (27) wherein the side gussets are permanently sealed to the parallel sheets of laminate. As mentioned before the sealing is followed by a cooling action to give the seal strength and required finish.

The photocell assembly (29) senses the required distances as marked on the laminate and conveys this information to the servo drive (31), so that the specified length of laminate is pulled for slitting. The slitting action is carried out at slitting station (30) that gives the end product in the shape of bag as defined by this invention.

It will be readily appreciated by those skilled in the art that the present invention is not limited to the specific embodiments herein shown. Thus variations may be made within the scope and spirit of the accompanying claims without sacrificing the principal advantages of the invention.

I claim:

1. A method of manufacturing a re-closable flexible package with a handle comprising the steps of:

inserting a side gusset tube between parallel sheets of laminate, folding edges of the tube and pre-sealing the same;

inserting a bottom gusset between said sheets of laminate, folding and pre-sealing the same;

inserting pre-cut handles between said sheets of laminate opposite to the bottom gusset;

inserting a pre-sealed zipper and diaphragm between the handles;

sealing the edges of the package to form the side and bottom gussets and collectively sealing the zipper, diaphragm and handle together; and slitting the bag along the side gusset tube to form the re-closable package with side and bottom gussets with the zipper, diaphragm and handle.

2. The method of claim 1, wherein the sealing step includes sealing the diaphragm to the zipper and the handles and between the zipper and each of the handles.

3. The method of claim 2, wherein the sealing step includes sealing an inner surface of the diaphragm to an outer surface of the zipper and sealing an outer surface of the diaphragm to an inner surface one of the handles, the inner surface of the diaphragm being opposite to the outer surface of the diaphragm.

* * * * *